United States Patent [19]

Engel

[11] Patent Number: 4,819,350

[45] Date of Patent: Apr. 11, 1989

[54] IRONING MACHINE

[75] Inventor: Harald Engel, Vienna, Austria

[73] Assignee: Texma Textilmaschinen und Armaturen Gesellschaft m.b.H., Vienna, Austria

[21] Appl. No.: 74,768

[22] Filed: Jul. 17, 1987

[30] Foreign Application Priority Data

Jul. 18, 1986 [EP] European Pat. Off. ..... 86 890212

[51] Int. Cl.[4] ..... D06F 71/00

[52] U.S. Cl. ..... 38/30; 38/71

[58] Field of Search ..... 38/30, 37, 27, 31, 12, 38/70, 71, 144

[56] References Cited

U.S. PATENT DOCUMENTS 1,392,289 10/1921 Benjamin et al. .
1,835,254 12/1931 Winnewisser ..... 38/12
3,501,857 3/1970 Schlemon .
3,665,624 5/1972 Briddell .
3,722,115 3/1973 Hanson .

FOREIGN PATENT DOCUMENTS 1528869 6/1968 France .
2177826 11/1973 France .
281074 12/1927 United Kingdom .
335341 9/1930 United Kingdom .
1493581 11/1977 United Kingdom .

*Primary Examiner*—Ronald Feldbaum
*Attorney, Agent, or Firm*—Herbert Dubno; Ronald Lianides

[57] ABSTRACT

An ironing machine provided with a pair of press plates are juxtaposed with respective elastic webs on tensioning frames which can stretch the webs with the article to be pressed between them so as to tension the article outwardly from the center on both sides, the tension being maintained during pressing.

16 Claims, 2 Drawing Sheets

IRONING MACHINE

FIELD OF THE INVENTION

My present invention relates to an ironing machine and, more particularly, to an ironing machine of the type which has upper and lower plates, means for approximating the plates to one another to press an article between them and for spacing the plates apart to permit insertion or withdrawal of the article and, generally, means for heating the plates or enabling the plates to afford delivery of moisture, e.g. in the form of steam to the article to be ironed or pressed.

BACKGROUND OF THE INVENTION

Ironing machines of the aforementioned type are known in the art and generally comprise upper and lower plates which press an article of clothing, e.g. trousers, between the juxtaposed surfaces of the plates. Usually, the plates themselves are shaped to suit the article which is to be pressed and one or both of them may have a steam feed line connected thereto.

Such ironing appliances have the drawback that, when the article of clothing has local regions with a greater number of layers than other parts, problems are encountered in the regions adjoining the thicker portion of the article. For example, in the ironing or pressing of trousers in the seam regions, so-called impressions can be formed along the seam of the trouser leg. This may require the subsequent hand ironing of the garment.

OBJECTS OF THE INVENTION

It is the principal object of the present invention to provide an improved ironing machine which can obviate the aforedescribed drawback.

Another object of the present invention is to provide an improved ironing method which can eliminate the formation of so-called impressions along thick or multilayer regions of a garment such as a trouser seam, in the ironing thereof.

Still another object of the invention is to provide an improved ironing machine which will automatically ensure a smooth ironing of a garment or other article, even in the case of seams or other rises thereof.

SUMMARY OF THE INVENTION

These objects and others which will become more readily apparent hereinafter are attained, in accordance with the present invention, in an ironing machine of the aforedescribed type having upper and lower plates, but wherein each of these plates has associated therewith a respective tensioning frame across which is spanned an elastically yieldable web of material, e.g. a fabric.

More particularly, the ironing machine comprises a lower pressing plate, a lower frame spanned by a respective elastically stretchable web juxtaposed with an upper surface of the lower pressing plate and adapted to be stretched across the upper surface, an upper pressing plate overlying the lower plate and the lower frame, the pressing plates being constructed and arranged to be relatively displaced toward and away from one another and an upper frame spanned by a respective elastically stretchable web juxtaposed with a lower surface of the upper pressing plate.

The upper web is also adapted to be stretched and the stretching of the webs can be effected by a relative displacement of the plates toward one another and the webs against at least one of the plates while an article to be pressed is received between the webs. Thus the webs upon being stretched across the respective surfaces, smooth and tension the article on both sides thereof prior to the pressing action which can be accomplished with heating and preferably also with the delivery of moisture, e.g. in the form of steam, by the pressing plates to the article.

Consequently, upon closing of the upper and lower plates together, the two web-tensioning frames can be shifted past the edges of the pressing surfaces of the plates so that the webs are tensioned thereagainst and are stretched from the middle outwardly to apply a similar smoothing and tensioning action to the article. This tension can also be maintained during drying of the article by means of a vacuum applied through the plates which may be perforated or otherwise fluid-permeable in the manner which is customary in the pressing machine art.

Mention may be made of the fact that it is known to provide manually actuated tensioning frames which are pivotable about a horizontal axis above a pressing plate and serve only to temporarily hold the article to be ironed. The frames do not operate automatically with elastic webs to tension and smooth the garment during the closing of the pressing plates and the ironing and drying action.

BRIEF DESCRIPTION OF THE DRAWING

The above objects, features and advantages of my invention will become more readily apparent from the following description, reference being made to the accompanying highly diagrammatic drawing in which.

SPECIFIC DESCRIPTION

Figure 1:
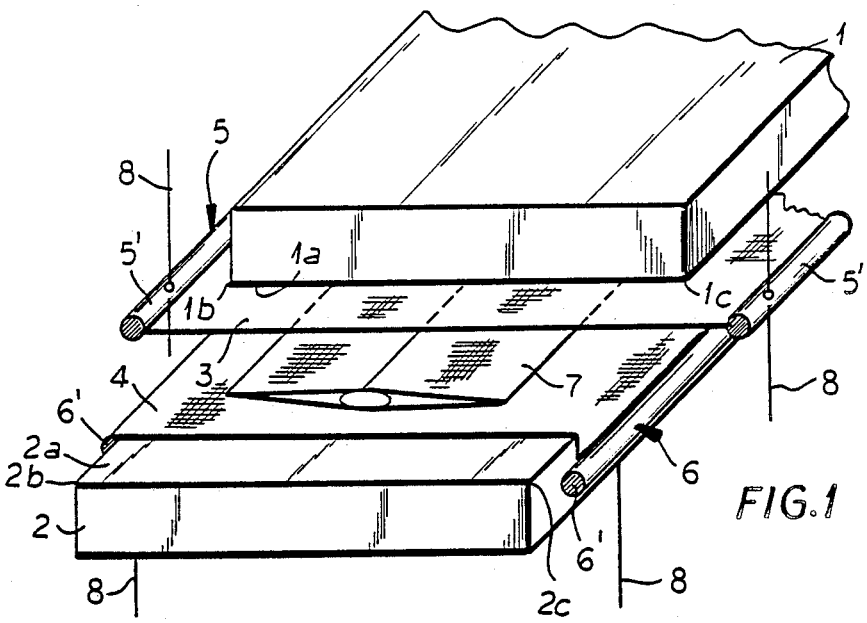
FIG. 1 is a perspective view illustrating certain key elements of the pressing machine of the invention, namely, the upper and lower pressing plates and the respective tensioning frames and webs in highly diagrammatic form.

As can be seen from FIG. 1, the ironing machine of the invention comprises an upper plate 1 which can be positioned in registry or vertical alignment with a lower plate 2. These plates may be provided with steam sources for heating the plates and releasing steam into an article to be ironed and with means for evacuating moisture from the article as part of the drying process. The specific plate structures for this purpose may be any of those used in ironing machines in the prior art, although the juxtaposed surfaces 1*a* and 2*a*, i.e. the lower surface of the upper plate and the upper surface of the lower plate, need not have any particular shape and can be flat.

As illustrated, the plates 1 and 2 can be displaced parallel to one another relatively vertically and can be closed on an article 7, e.g. a trouser leg, to be ironed or opened to permit removal and insertion of the trouser leg. The upper plate may also be swung aside as shown diagrammatically in FIG. 2 for this purpose, i.e. to permit the unhindered placement of the article to be ironed on the lower plate 2.

The upper plate 1 is associated with a tensioning frame 5 whose limbs 5' have been shown, these limbs lying parallel to the longitudinal edges 1*b* and 1*c* of the upper plate 1 but laterally outwardly thereof.

The limbs 5' are spanned by a web 3 of an elastic material juxtaposed with the surface la and generally at the level of this surface.

Figure 3:
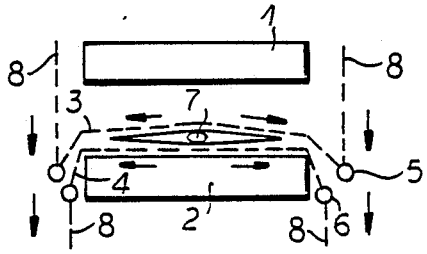
Figure 4:
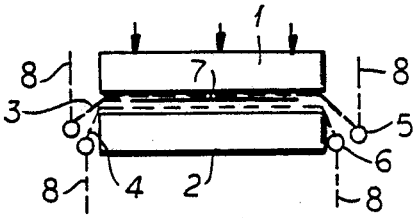

The lower plate 2 is juxtaposed with an elastic web for spanning the limbs 6' of a frame 6, the limb 6' lying parallel to the longitudinal edges 2*b* and 2*c* of the lower plate 2, outwardly of the latter, but inwardly of the limbs 5' (see FIGS. 3 and 4).

The web 4 also lies approximately at the level of the surface 2*a*.

Between the two webs, the article 7 to be pressed can be inserted and since the frames 5 and 6 are vertically guided, appropriate vertical guides have been represented at 8 for them.

The webs are preferably constituted from elastic stretchcord fabric which has been found to be especially effective and has been used in the past for ski pants.

The ironing machine is provided with a central control unit which has not been illustrated in FIGS. 1–4 and can have pneumatic, especially electropneumatic or hydraulic operators for positioning the various parts, i.e. for actuating the upper and lower parts 1 and 2 and their associated tensioning frames 5 and 6.

As is apparent from FIGS. 1–4, the limbs 5', 6' of the frames are not only parallel to one another, but also to the respective edges of the ironing surfaces of the plates.

Figure 2:
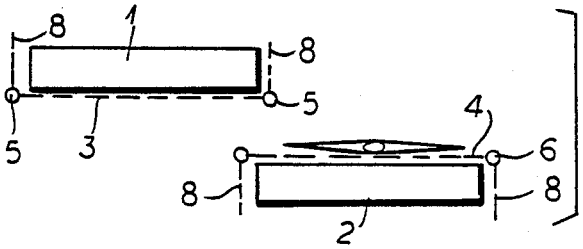
FIGS. 2–4 are end views showing, also highly diagrammatically, various positions of the frames and the pressing plates.

The machine is operated as follows:

As can be seen from FIG. 2, the trouser 7 to be ironed is laid upon the web 4 which is not yet in a stretched state. The plate 1 and the web 3 are then swung back into alignment with the lower plate 2 (FIG. 3).

The two tensioning frames 5 and 6 are then lowered to stretch first the web 4 and then the web 5 over the edges of the plate 2 and then draw out the web from the center to either side as represented by the arrows in FIG. 3.

Folds in the article 7 to be pressed are likewise stretched and the article is smoothed from both sides outwardly. The upper plate 1 is then lowered toward the lower plate 2 as represented by the vertical arrows in FIG. 4 and the article 7, i.e. the trousers, is then pressed in the usual manner with heat and moisture, e.g. steam.

Following ironing, the machine is opened, i.e. the pressing plate 1 is raised to its original position together with the tensioning frame 5 and the frame 6 is likewise lifted to permit relaxation of the respective layers 3 and 4 and enabling the removal of the article.

It should be apparent that the stretching of the webs can be effected by moving them both against the upper plate as an alternative and indeed the closing of the press can be effected by moving the lower plate 2 toward the upper plate 1 or both plates toward one another. If required, the various steps can be carried out under control of a microprocessor or computer by so-called programmed control.

The tensioning frames 5 and 6 need not be formed with two parallel limbs but rather can be constituted as a U-shaped or stirrup-shaped frame or even as a rectangular frame. In many cases, it is advantageous to shape the frame and the web to the configuration of the articles to be ironed, e.g. with a sector-shape or a circular shape.

The invention also comprehends a method of ironing in which the ironing is effected through the application of heat and pressure, preferably with the supply of moisture, automatically smoothing the article from both sides from the center toward edge zones and maintaining a tension on the article before and during the application of heat and moisture. Creasing of the article is thereby completely avoided.

Figure 5:
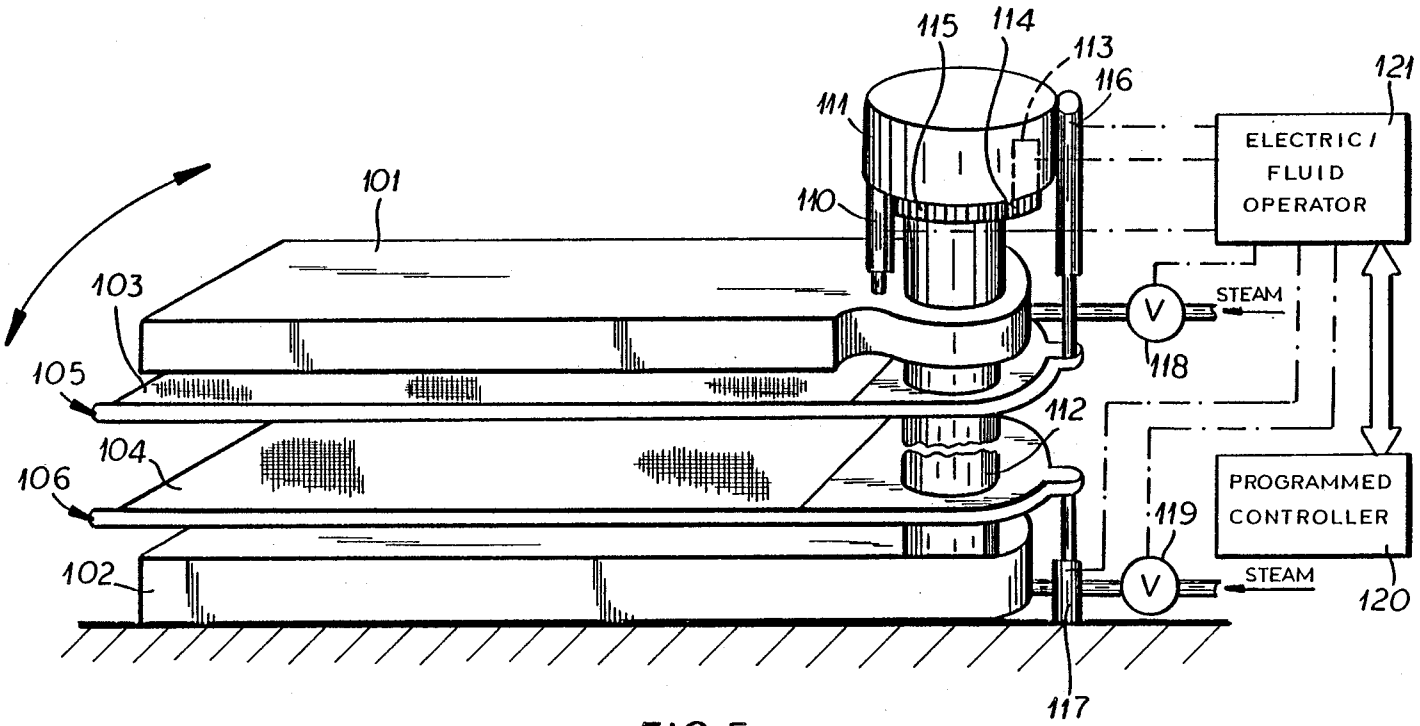
FIG. 5 is a perspective side view diagrammatically illustrating an automatic machine in accordance with the principles of this invention.

In FIG. 5 in highly diagrammatic form, I have shown an upper press plate 101 which is actuated by a cylinder 110 connected to a head 111 which rotates on the vertical guide post 112 of the pressing machine. The head 111 can be rotated, in turn, by a motor 113 which is fluid-operated and has a pinion 114 engaging a gear ring 115 keyed to the post 112.

The upper frame 105, spanned by the elastic web 103 is vertically displaceable by a cylinder 116 connected to the head 111.

The lower frame 106 spanned by the elastic web 104 is vertically displaceable by a cylinder 117.

The upper plate 101 is connected to a steam source through a valve 118, and the lower plate 102 is connected to a steam source through a valve 119.

The apparatus of FIG. 5 is amenable to programmed operation by a programmer controller 120, e.g. a microcomputer provided with a microprocessor and which, in turn, controls a multiplicity of operators I21 which are preferably electropneumatic operators but can also be hydraulic operators supplying the various cylinders and valves.

The motor 113, Which can also be fluid-operated, permits the plate 101 and the frame 105 to swing about the vertical axis in the manner previously described while the cylinders permit raising and lowering of the frames in the manner previously described to accomplish the sequence of operations shown in FIGS. 2–4.

I claim:

1. An ironing machine, comprising:

at least one pressing plate having a surface;

a lower frame spanned by a respective elastically stretchable web juxtaposed with said surface of said pressing, plate and adapted to be stretched across said surface; and an upper frame spanned by a respective elastically stretchable web juxtaposed with said surface of said pressing plate and adapted to be stretched across said surface whereby an article received between said webs is smoothed upon said frames being displaced relative to said plate so that the webs are stretched across said surface.

2. The ironing machine defined in claim 1 wherein said plate is one of a pair of pressing plates including an upper pressing plate having a lower surface juxtaposed with said web of said upper frame and a lower plate having an upper surface juxtaposed with the web of said lower frame, said plates having said webs between them and being adopted to be relatively displaced toward and away from one another.

3. The ironing machine defined in claim 2 wherein each of said frames has a pair of mutually parallel limbs substantially parallel to but outwardly of respective longitudinal edges of said plates and spanned by the respective webs.

4. The ironing machine defined in claim wherein each of said webs is a Stretchcord fabric.

5. The ironing machine defined in claim 2, further comprising means for vertically guiding at least one of said plates for said movement toward and away from the other of said plates.

6. The ironing machine defined in claim 5, further comprising means for mounting said upper plate for swinging movement about a vertical axis lateraly out of vertical alignment with said lower plate.

7. The ironing machine defined in claim 6 wherein said upper plate is the vertically guided said one of said plates.

8. The ironing machine defined in claim 2, further comprising means for vertically guiding each of said frames for movement parallel to said plates and in a direction of movement of at least one movable one of said plates, but independently of the movement of either of said plates.

9. The ironing machine defined in claim 8 wherein each of said frames is positioned in an unstretched position of the respective web so that each respective web lies at the level of the respective one of said surfaces.

10. The ironing machine defined in claim 9 wherein both of said frames are displaceable below the level of said upper surface of said lower plate to stretch both of said webs thereacross.

11. The ironing machine defined in claim 2, further comprising powered positioning means connected to at least one of said plates and to said plates for controlledly displacing same.

12. The ironing machine defined in claim 11, further comprising a central control unit connected to said positioning means for programmed operation thereof.

13. The ironing machine defined in claim 11 wherein said positioning means includes a pneumatically controlled operator.

14. The ironing machine defined in claim 11 wherein said positioning means includes an electropneumatically controlled operator.

15. The ironing machine defined in claim 11 wherein said positioning means includes a hydraulically controlled operator.

16. A method of ironing an article, especially trousers, comprising the steps of:

introducing said article between a pair of heatable and moisture-deliverable pressing plates;

closing said plates on said article and pressing said article between said plates while heating said article with said plates and delivering moisture to said article by said plates; and prior to the pressing of said article between said plates with heating and delivery of moisture thereto, subjecting said article to an outward tension between stretching webs on opposite sides of said article and applied from the center of said article outwardly and maintaining said tension on said article during pressing and the effect of said heating and of said moisture delivery.

* * * * *